US005659835A

United States Patent [19]

Earle et al.

[11] Patent Number: 5,659,835

[45] Date of Patent: Aug. 19, 1997

[54] REPLENISHMENT OF PROCESSES

[75] Inventors: Anthony Earle, Harrow Weald; John Richard Fyson, Hackney; Edward Charles Timothy Samuel Glover, London, all of England

[73] Assignee: Eastman Kodak Company, Rochester, N.Y.

[21] Appl. No.: 407,834

[22] Filed: Mar. 21, 1995

[30] Foreign Application Priority Data

Mar. 25, 1994 [GB] United Kingdom ..... 9405947

[51] Int. Cl.[6] ..... G03D 3/02; G03D 5/00; G03D 3/08

[52] U.S. Cl. ..... 396/626

[58] Field of Search ..... 354/317, 318, 354/319–325, 331, 336; 134/64 P, 64 R, 122 P, 122 R; 430/398–400, 302, 309, 379, 407, 434, 608, 372

[56] References Cited

U.S. PATENT DOCUMENTS

| | | | |
|---|---|---|---|
| 3,379,528 | 4/1968 | Henn et al. | 430/608 |
| 3,418,912 | 12/1968 | Land et al. | 354/318 |
| 3,680,463 | 8/1972 | Attridge et al. | 354/298 |
| 4,310,616 | 1/1982 | Hamada et al. | 430/309 |
| 4,417,802 | 11/1983 | Forbes | 118/653 X |
| 4,466,722 | 8/1984 | Staude | 354/325 X |
| 4,537,496 | 8/1985 | Ohba et al. | 118/691 X |
| 4,647,173 | 3/1987 | Schar | 354/324 X |
| 4,826,757 | 5/1989 | Yamada et al. | 430/399 X |
| 4,929,975 | 5/1990 | Shidara | 354/324 X |
| 5,006,439 | 4/1991 | Wernicke et al. | 430/379 |
| 5,089,839 | 2/1992 | Nakano et al. | 354/317 |
| 5,114,836 | 5/1992 | Sato et al. | 430/434 |
| 5,177,522 | 1/1993 | Hayashi | 354/320 |
| 5,210,005 | 5/1993 | Takekoshi et al. | 354/319 X |
| 5,353,084 | 10/1994 | Twist et al. | 354/324 X |

FOREIGN PATENT DOCUMENTS

| | | |
|---|---|---|
| 0 029 722 | 6/1981 | European Pat. Off. . |
| 0 300 522 | 1/1989 | European Pat. Off. . |
| 39 42 395 | 6/1991 | Germany . |
| 4-293054 | 10/1992 | Japan . |
| 05265152 | 10/1993 | Japan . |
| 92/07665 | 5/1992 | WIPO . |

*Primary Examiner*—D. Rutledge
*Attorney, Agent, or Firm*—Frank Pincelli

[57] ABSTRACT

It is well known that photographic processing solutions need to be replenished periodically in photographic processing apparatus to maintain constant sensitometry for the material being processed. Described herein is a method and apparatus for effecting replenishment of a process, in particular, a photographic process, in which replenishing material for the process is coated on to at least one surface of the material to be treated in that process.

6 Claims, 2 Drawing Sheets

REPLENISHMENT OF PROCESSES

FIELD OF THE INVENTION

The present invention relates to the replenishment of processes and is more particularly, although not exclusively, concerned with the replenishment of photographic processes.

BACKGROUND OF THE INVENTION

It is well known that photographic processing solutions need to be replenished periodically in photographic processing apparatus to maintain constant sensitometry for the material being processed. Replenishment is made to the processing solutions so that their chemical composition and activity are kept within specified limits to maintain sensitometry for the material being processed.

Replenishment of photographic solutions is dependent on the area of the material being processed. However, this is not the sole dependency. Normally, other factors are also considered to effect complete replenishment. The present invention is applicable to replenishment which is dependent on the area of material being processed assuming that an average exposure has been given to the material.

In most processing apparatus, the area of material being processed is determined by measuring the length of the material being processed by mechanical or optical means assuming that the material has a fixed width. Additionally, if the width of the material is not fixed, the width may also be measured using suitable means, for example, infrared sensors positioned across the width of the entry slot to the processing apparatus.

Once the area of the material being processed has been determined, replenisher solutions are then pumped into the appropriate processing tank or tanks at a rate related to that area to effect replenishment.

PROBLEM TO BE SOLVED BY THE INVENTION

In order to achieve this replenishment, fairly accurate pumps are required, one for each processing solution. Alternatively, if the replenishing solutions are mixed prior to addition to the processing tank, one for each processing tank. Means are also required to measure the area of the material being processed.

SUMMARY OF THE INVENTION

It is, therefore, an object of the present invention to provide a simpler, more reliable method of replenishing a process.

In accordance with one aspect of the present invention, there is provided a method of replenishing a process characterized in that replenishing material is coated on to at least one side of the material to be processed prior to transfer into the process.

In accordance with a second aspect of the present invention, there is provided apparatus for effecting replenishment of a process, the apparatus comprising at least one processing stage for processing a material, and at least one replenishing material application stage, positioned prior to the at least one processing stage, for applying replenishing material to the material to be processed.

ADVANTAGEOUS EFFECT OF THE INVENTION

When the present invention is used for replenishing a photographic process, replenishing material is applied to the non-emulsion surface of photographic material to be processed prior to its transfer to that process. This removes the need to measure the area of the material to be processed as an equivalent area to that to be processed is applied with replenishing material.

Furthermore, pumps for adding the replenisher solution to the appropriate processing stage are no longer necessary.

BRIEF DESCRIPTION OF THE DRAWINGS

For a better understanding of the present invention, reference will now be made, by way of example only, to the accompanying drawings in which.

DETAILED DESCRIPTION OF THE INVENTION

In the method and apparatus of the present invention, replenishing material is continuously coated on to the non-emulsion side of photographic material across its entire width. The replenishing material does not react directly with the material on to which it is coated, but is carried into the processing stage which requires replenishment. Here, the replenishing material mixes into the bulk of the processing solution off the non-emulsion side of the material as it is being processed in an amount which is directly related to the area of material being processed.

Figure 1:
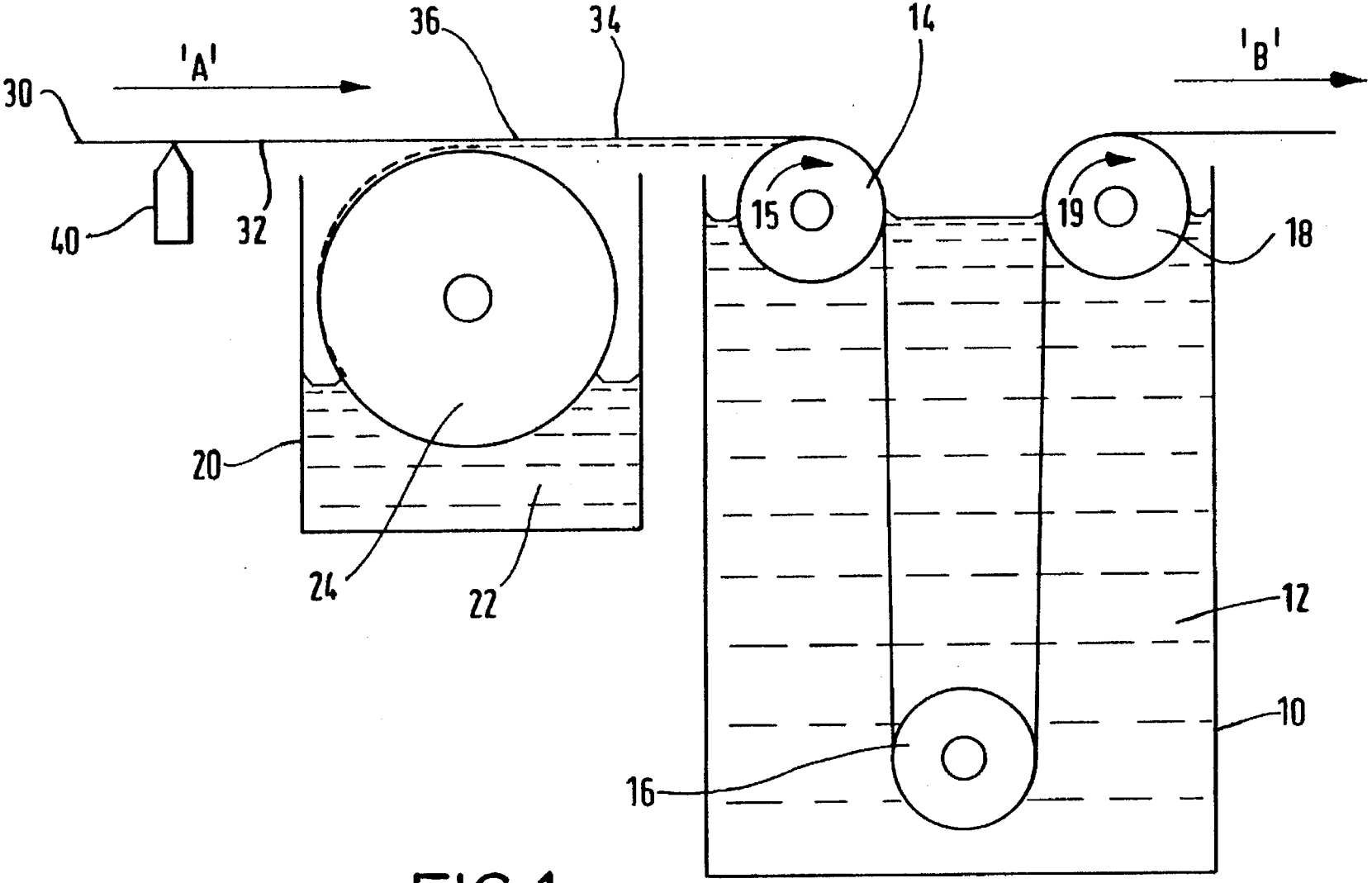
FIG. 1 is a schematic side elevational view of part of a photographic processing apparatus embodying the present invention.
Figure 2:
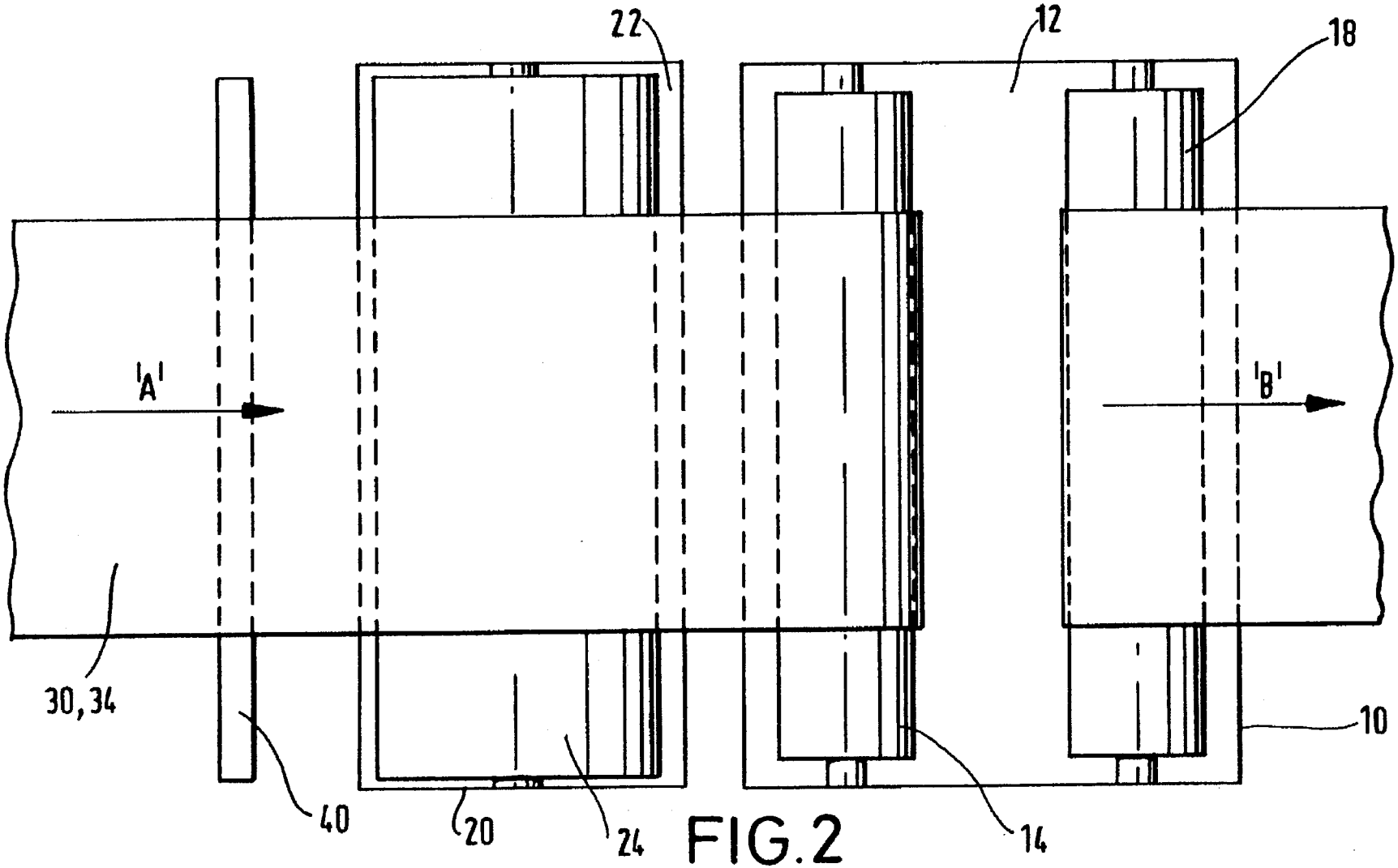
FIG. 2 is plan view of the apparatus shown in FIG. 1.

FIGS. 1 and 2 show photographic processing apparatus in which the present invention can be utilized. A single processing stage is shown, but it is can be readily understood that the present invention can be applied to more than one processing stage, each carrying out a different processing step and having different replenishment needs.

A processing tank 10 is shown containing processing solution 12. Three rollers 14, 16, 18 are associated with this tank 10 for the transport of material therethrough, the rollers 14, 18 rotating in the direction indicated by arrows 15, 19 respectively. Rollers other than those shown may also be utilized.

Prior to the processing tank 10, a replenisher application stage is positioned which comprises a replenisher tank 20 having replenisher solution 22 retained therein. A gravure roller 24 is positioned in the tank 20 in contact with the replenisher solution 22 for transferring replenisher solution from the tank 20 on to non-emulsion surface 32 of photographic material 30.

The gravure roller 24 is profiled to apply a predetermined amount of replenisher solution 22 from the tank 20 on to the material 30, and provides a coating of substantially uniform thickness.

Upper surface 34 of material 30 is the emulsion surface. This application of replenisher solution 24 to the non-emulsion surface 32 is shown by dotted lines 36 in FIG. 1.

As the photographic material 30 passes from a previous processing tank with its emulsion surface 34 uppermost, as indicated by the direction of arrow 'A', it passes over a squeegee 40 which removes any retained processing solution from the previous processing tank from the non-emulsion surface 32 so that replenisher solution 22 can be applied thereto by the roller 24.

Once the replenisher solution has been applied, as shown by dotted lines 36, the material 30 passes into the processing tank 10 over roller 14, round roller 16 and up over roller 18, to the next processing tank, in the direction indicated by arrow 'B'. While the material 30 is in tank 10, the replenisher solution coated on its non-emulsion surface 32 mixes with the processing solution 12 in tank 10 to effect replenishment.

It may be necessary to remove the replenisher solution from the under surface of the material instead of relying on the mixing of the solution with the processing solution in the tank. This can be achieved by using nip rollers positioned in the processing tank. Doctor blades or any other suitable means may also be employed for this purpose.

If it is desired to know the area of material processed, this can readily be determined from the amount of replenisher solution 22 removed from the replenisher tank 20. In particular, if the tank 20 starts with a known volume of liquid which is used until exhausted, the amount of liquid required to refill the tank 20 can easily be measured.

The gravure roller 24 may have a circumferential surface which is textured. For example, the roller surface may be stippled or smooth. Furthermore, a fine spiral pattern may be cut into the surface. Coarser multi-start spirals may also be utilized. Moreover, grooves may be cut into the roller surface to form longitudinally or radially extending lands, the outer surface of the lands coming into contact with the material to apply replenisher solution.

The concentration of the replenisher solution 22 can be varied to alter the replenishment rate. This can be achieved in several ways.

One method of altering the replenishment rate is to vary the area of contact which the gravure roller 24 makes with the material 30. For example, gravure roller 24 may be arranged to contact the material 30 over a given proportion of its area, say 30%. This may be achieved by arranging for the roller 24 to be moved laterally relative to the direction of motion of the material 30 so that only a certain area of the roller 24 contacts the material 30. However, this method cannot be used without knowledge of the width of the material. Ideally, this method would need to be used in conjunction with known methods for determining the area of the material being processed, that is, the width of the material, so that the appropriate amount of replenisher solution is applied.

Alternatively, the concentration of the replenisher solution 22 itself in the replenisher tank 20 can be altered as desired.

Additionally, the time for which contact is made between the gravure roller 24 and the material 30 can be adjusted to vary the amount of replenisher solution 22 applied to the material 30 and hence the replenishment rate for the following processing tank 10. This contact time would need to be controlled. For example, if the exposure given to the material being processed is known, the replenishment rate can be adjusted by controlling the overall contact time between the roller and the material in accordance with that exposure.

The replenisher solution may also be applied to the emulsion surface 34, but the speed at which the material moves into the processing tank 10 needs to be sufficiently fast that little reaction takes place between the replenisher solution and the emulsion surface so as not to impair the end results of the processing.

The material being processed may be photographic film or paper in web form. Alternatively, sheet materials can also be processed in this way.

Naturally, the material being processed may be color, black-and-white or graphics materials.

If replenisher solution is applied over the entire under surface of the material, as is preferred, there is no need to align the material as it enters the replenisher application stage and the processing tank. This is because there is no need to determine the width of the material.

The replenisher solution may be applied to the material being processed by means other than gravure rollers. For example, wiper blades may be used for both applying the coating to the under surface of the material and for removing the replenisher solution from the material in the processing tank.

Instead of a single gravure roller, a plurality of rollers on a single axle may be employed where each roller is spaced from an adjacent roller. However, the width of the material being processed would need to be known so that an effective replenishment rate can be determined.

Furthermore, it may be desirable to apply different solutions in stripes on to the material. These solutions could then be mixed in the processing tank. It may be desired that some mixing of different solutions takes place on the material prior to entering the processing tank. As mentioned above, the width of the material would need to be known so that the solutions could be mixed in the correct proportions.

More than one set of rollers may be utilized, the second or subsequent set(s) being offset with respect to the first set and lie between adjacent rollers of the first set.

Although the present invention has been described with reference to the replenishment of photographic processing apparatus and solutions used therein, it will be appreciated that the present invention is not limited to such application.

Furthermore, in other applications, it may be desirable to coat both sides of the material to be processed prior to processing. This may be advantageous where it is desired that two replenisher solutions interact in the processing stage, but not before, and by applying one on each side of the material, the material acts as a barrier prior to entry into the processing stage where the solutions can then mix.

Parts List:

10 . . . processing tank
12 . . . processing solution
14,16,18 . . . rollers
15,19 . . . arrows
20 . . . replenisher tank
22 . . . replenisher solution
24 . . . gravure roller
30 . . . photographic material
32 . . . non-emulsion surface
34 . . . upper surface
36 . . . dotted lines
40 . . . squeegee

We claim:

1. A method of replenishing a photographic processing solution used to process a photographic material, the method characterized by the step of coating a replenishment material for said processing solution on the surface of said photographic material prior to the photographic material being subjected to the processing solution such that when said photographic material is subjected to said processing solution, said coating provides replenishment constituents to said processing solution so as to maintain the sensitometry of said processing solution.

2. A photographic processing apparatus for processing photographic material having a surface, the apparatus comprising at least one processing stage having a processing solution which is used to process said photographic material, characterized in that the apparatus further includes a replenishment means located prior to said processing stage and for applying a replenishment material to said photosensitive material, the replenishment means comprising a coating station for coating replenishment material on said surface of said photographic material so as to form a coating, said replenishment coating is used to maintain the sensitometry of said processing solution.

3. Apparatus according to claim 2, wherein the coating station includes a roller for applying the replenishing material to the material to be processed.

4. Apparatus according to claim 3, wherein the roller is a gravure roller.

5. Apparatus according to claim 2, wherein the coating station includes a hopper for applying the replenishing material to the material to be processed.

6. Apparatus according to claim 2, wherein the apparatus comprises photographic processing apparatus having a plurality of processing stages, at least one of the processing stages having a preceding replenishing material application stage associated therewith.

* * * * *